US006456809B1

(12) United States Patent
Sekiguchi

(10) Patent No.: US 6,456,809 B1
(45) Date of Patent: Sep. 24, 2002

(54) DEVELOPING-AGENT RECEIVING DEVICE FEATURING A STORAGE PART AND FIRST AND SECOND STIRRING MEMBERS

(75) Inventor: Hajime Sekiguchi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/426,944

(22) Filed: Oct. 26, 1999

(30) Foreign Application Priority Data

Oct. 29, 1998 (JP) ..... 10-322929

(51) Int. Cl.[7] ..... G03G 15/08
(52) U.S. Cl. ..... 399/254; 399/256
(58) Field of Search ..... 399/254, 256, 399/263; 366/318, 319, 325.1, 327.1, 327.3, 327.4, 329.1

(56) References Cited

U.S. PATENT DOCUMENTS 5,629,758 A * 5/1997 Kageyama et al. ..... 399/263
5,950,056 A * 9/1999 Hamamichi et al. ..... 399/256
5,963,766 A * 10/1999 Okuno et al. ..... 399/256
6,035,168 A * 3/2000 Masuda et al. ..... 399/254

FOREIGN PATENT DOCUMENTS

EP 0 475 332 3/1992
JP 59-100472 6/1984
JP 62-182769 8/1987
JP 4-191767 7/1992
JP 11-160985 * 6/1999

OTHER PUBLICATIONS

Patent Abstracts of Japan, vol. 008, No. 215 (P–305) (JP 59–100472, Oct. 2, 1984), Jun. 9, 1984.
Patent Abstracts of Japan, vol. 012, No. 029 (P–660) (JP 62–182769, Jan. 28, 1988), Aug. 11, 1987.
Patent Abstracts of Japan, vol. 016, No. 516 (P–1443) (JP 04–191767, Oct. 23, 1992), Jul. 10, 1992.

* cited by examiner

*Primary Examiner*—Quana M. Grainger
(74) *Attorney, Agent, or Firm*—Fitzpatrick, Cella, Harper & Scinto

(57) ABSTRACT

A developing-agent receiving device, to which a developing agent is replenished from a developing-agent replenishment container, includes a developing-agent storage part which is provided with a receiving opening part for receiving the developing agent from the developing-agent replenishment container, and which stores the developing agent, and a stirring unit which is rotatable around a rotary shaft to stir the developing agent within the developing-agent storage part. The stirring unit conveys the developing agent received from the receiving opening part along the rotary shaft of the stirring unit. The stirring unit has a first stirring member of screw shape which is provided in the vicinity of the receiving opening part and a second stirring member which is provided at a position farther away from the receiving opening part than the first stirring member and which is smaller in developing-agent conveying capacity than the first stirring member.

7 Claims, 10 Drawing Sheets

DEVELOPING-AGENT RECEIVING DEVICE FEATURING A STORAGE PART AND FIRST AND SECOND STIRRING MEMBERS

BACKGROUND OF THE INVENTION

1. Field of the Invention

The present invention relates to a developing-agent receiving device arranged to receive the supply of a developing agent from a developing-agent supply container, and more particularly, to a developing-agent receiving device arranged to supply a developing agent to a developing device.

2. Description of Related Art

A conventional image forming apparatus is provided with a photosensitive member serving as a latent-image bearing member, forms an electrostatic latent image on the photosensitive member by a charger, an exposure device, etc., and makes the electrostatic latent image into a visual image by supplying the developing agent by a developing device.

The above-described visual image is transferred by a transfer device onto a transfer member which is a recording medium which is stored in a paper feed cassette and supplied to the photosensitive member through a paper feed roller, a conveying roller, etc., and is conveyed, together with the transfer member, to a fixing device by a conveying device provided close to a heat discharge fan, is heated and pressed in the fixing device, is fixed onto the transfer member into a permanent image, and is discharged outside the apparatus body as a final copy together with the transfer member.

In such a conventional image forming apparatus, a developing device is provided with a developing sleeve which is a developing-agent bearing member to adhere the developing agent to the electrostatic latent image on the photosensitive member, and a developer container to store the developing agent, and is also provided with a developing-agent storage device (hereinafter, referred to as "storage device") serving as a developing-agent receiving device including a developing-agent storage part as a developing-agent storage container so as to replenish the developing agent to the developer container.

In addition, a bottle which is a developing-agent replenishment container attachable/detachable to/from the storage device is provided on an upper part of the storage device, enabling replenishment of the developing agent to the storage device.

FIG. 10 illustrates the constitution of the bottle and the storage device provided in such an image forming apparatus. That is, the developing agent is supplied from a bottle 11 to a storage device 12 not by forming a discharge port of the bottle 11 to be large, but through a connection port 11*a* which is a supply port as a communication part provided on an end part in the longitudinal direction of the storage device 12, and the developing agent is supplied from the storage device 12 to a developer container 112*a* through an opening 12*a* over the whole area in the longitudinal direction of the developer container 112*a*.

As described above, the developing agent is supplied from the end part in the longitudinal direction of the storage device 12. Therefore, even when the developing agent is made of ultra-fine particles with high flowability, any large volume of developing agent is not scattered when the developing agent is transferred from the bottle 11 to the storage device 12, or immediately after the bottle 11 is detached from the storage device 12 upon completion of the transfer, and members nearby are not stained with the scattered developing agent.

However, with the above constitution, it can take long time to replenish the developing agent. Therefore, in the conventional developing device, a conveying means 14 composed of a screw or the like is provided within the bottle 11, as illustrated in FIG. 10, so that the developing agent is replenished in a short time.

Further, in such a constitution as to supply the developing agent from the end part in the longitudinal direction of the storage device 12, the distribution of the developing agent in the longitudinal direction of the storage device 12 can be nonuniform. Therefore, a developing-agent leveling means 15 (hereinafter, referred to as "leveling means") serving as a stirring means is provided in the storage device 12, as shown in FIG. 10, and the developing agent is supplied from the storage device 12 to the developer container 112*a* over the whole area in the longitudinal direction of the developer container 112*a*. Thus, the distribution of the developing agent in the longitudinal direction becomes uniform, and no defective images are formed.

However, the quantity of discharge (the quantity of supply) per unit time from the bottle 11 is limited to the quantity corresponding to the leveling speed of the leveling means 15. That is, the quantity of discharge is set by changing the rotational frequency of the leveling means 15. The above-described rotational frequency is determined considering the constitution of the drive system, the effect on the toner, or the like.

Thus, when the quantity of discharge from the bottle 11 is set to the quantity exceeding the limit of the leveling speed of the leveling means 15, the connection port 11*a* between the storage device 12 and the bottle 11 can be stuffed with the toner, which would then overflow there.

BRIEF SUMMARY OF THE INVENTION

It is, therefore, an object of the present invention to provide a developing-agent receiving device capable of preventing a developing-agent storage container from being stuffed with the toner and preventing the toner from overflowing there, and capable of increasing the quantity of supply of the developing agent to the developing-agent storage container from a developing-agent replenishment container.

Another object of the present invention is to provide a developing-agent receiving device in which, in a developing-agent storage container provided with an opening part for receiving the developing agent to be replenished from a developing-agent replenishment container, the developing-agent conveying capacity in the vicinity of the opening part is made larger than the developing-agent conveying capacity at the position away from the opening part.

Still another object of the present invention is to provide a developing-agent receiving device in which the developing-agent stirring capacity at the position away from the opening part is made larger than the developing-agent stirring capacity in the vicinity of the opening part.

The above and further objects and features of the present invention will become apparent from the following detailed description of preferred embodiments thereof taken in conjunction with he accompanying drawings.

DETAILED DESCRIPTION OF THE INVENTION

Hereinafter, preferred embodiments of the present invention will be described in detail with reference to the drawings.

First Embodiment

Firstly, an image forming apparatus according to a first embodiment of the present invention is described.

Figure 1:
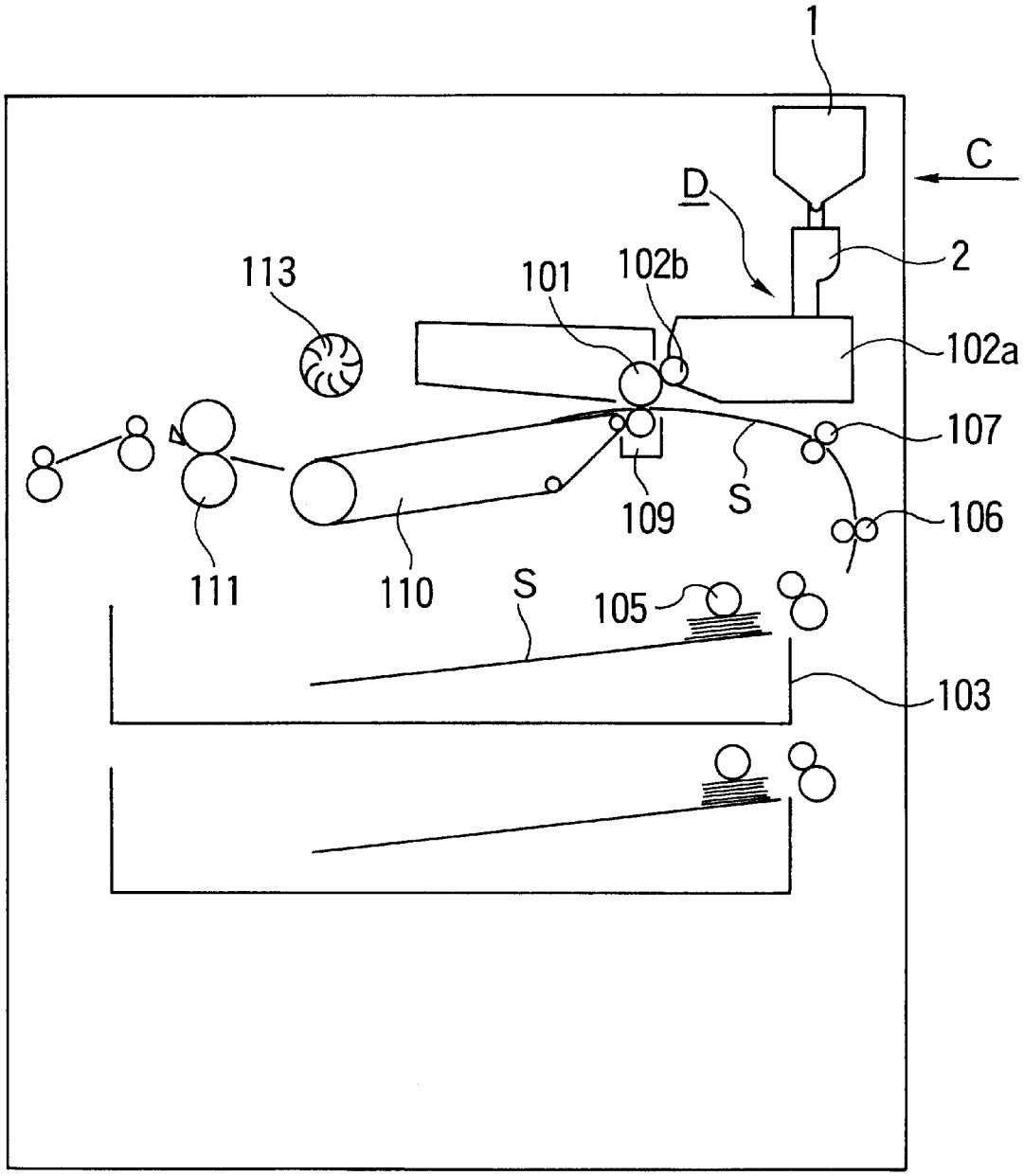
FIG. 1 is a schematic sectional view showing an outline constitution of an image forming apparatus according to a first embodiment of the present invention.

FIG. 1 is a schematic sectional view showing an outline constitution of the image forming apparatus according to the first embodiment.

The image forming apparatus according to the first embodiment is provided with a photosensitive member 101 serving as a latent-image bearing member as shown in FIG. 1. An electrostatic latent image is formed on the photosensitive member 101 by a charger (not shown), an exposure device or the like, and the electrostatic latent image is turned into a visual image by supplying a developing agent by a developing device D.

The visual image is transferred onto a transfer member S, which is stored in a paper feed cassette 103 and supplied to the photosensitive member 101 through a paper feed roller 105, conveying rollers 109 and 107, or the like, by a transfer device 109, is carried to a fixing device 111 by a conveying device 110 provided close to a heat radiation fan 113 together with the transfer member S, is heated and pressed in the fixing device 111, is fixed to the transfer member S into a permanent image, and is discharged outside a body of the apparatus together with the transfer member S as a final copy.

Figure 2:
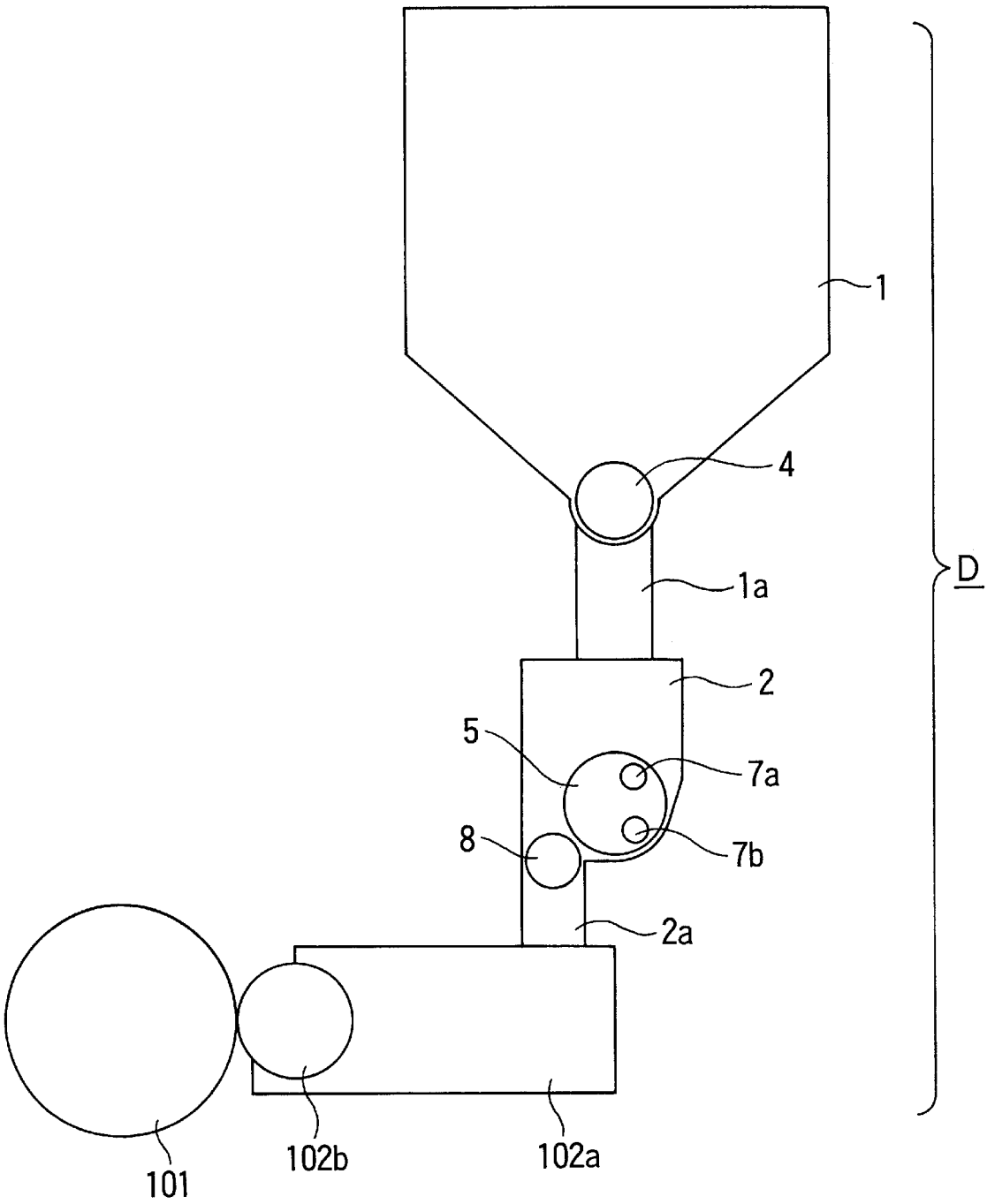
FIG. 2 is a schematic sectional view showing an outline constitution of a developing device provided in the image forming apparatus shown in FIG. 1.

The image forming apparatus according to the first embodiment is provided, as shown in FIG. 2, with a developing sleeve 102*b* to adhere the developing agent to the electrostatic latent image on the photosensitive member 101, and a developer container 102*a* to store the developing agent, and, in addition, is provided with a developing-agent storage device 2 (hereinafter, referred to as "storage device") serving as a developing-agent receiving device provided with a developing-agent storage part serving as a developing-agent storage container in order to replenish the developing agent to the developer container 102*a*.

Figure 3:
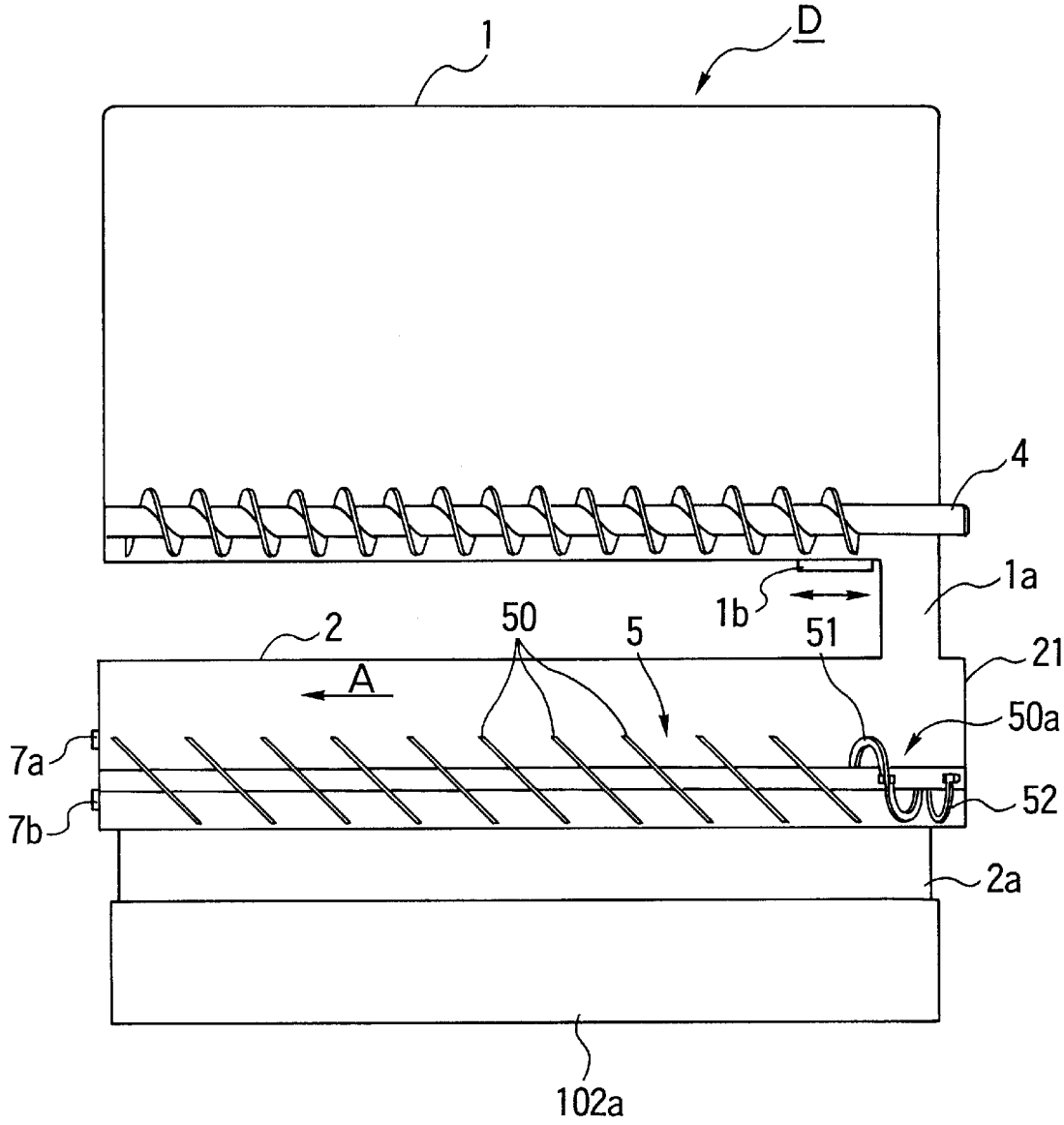
FIG. 3 is a side view of an outline constitution of the developing device shown in FIG. 2.

FIG. 3 shows an outline constitution of a developing-agent replenishment container and the developing-agent storage part in the first embodiment of the present invention.

In addition, a bottle 1 serving as the developing-agent replenishment container attachable/detachable to/from the storage device 2 is provided on an upper part of the storage device 2, so that the developing agent can be replenished into the storage device 2.

The constitution of the bottle 1 and the storage device 2 provided in the image forming apparatus is shown in FIG. 3 which is a view from the direction of the arrow C in FIG. 1. That is, the developing agent is supplied from the bottle 1 to the storage device 2, not by forming a discharge port in the bottle 1 to be large, but through a connection port 1*a* which is a supply port as a communication part provided on an end part in the longitudinal direction of the storage device 2. On the other hand, the developing agent is supplied from the storage device 2 to the developer container 102*a* through an opening 2*a* over the whole area in the longitudinal direction of the developer container 102*a*.

As described above, the developing agent is supplied from the end part in the longitudinal direction of the storage device 2. Therefore, even when the developing agent is made of ultra-fine particles with high flowability, any large volume of developing agent is not scattered when the developing agent is transferred from the bottle 1 to the storage device 2, or immediately after the bottle 1 is detached from the storage device 2 upon completion of the transfer, and members nearby are not stained with the scattered developing agent.

In the first embodiment, a developing-agent conveying means 4 composed of a screw or the like is provided in the bottle 1 as shown in FIG. 3, so that the developing agent is replenished in a short time.

Further, in such a constitution for supplying the developing agent from the end part in the longitudinal direction of the storage device 2, the distribution of the developing agent in the longitudinal direction of the storage device 2 can be non-uniform. Therefore, a developing-agent leveling means 5 (hereinafter, referred to as a "leveling means"), which serves" as a stirring means for stirring the developing agent, is provided in the storage device 2, as shown in FIG. 3. The developing agent is supplied from the storage device 2 to the developer container 102*a* through the opening part 2*a* over the whole area in the longitudinal direction of the developer container 102*a*. Thus, the distribution of the developing agent in the longitudinal direction becomes uniform, and no defective images are formed.

In the image forming apparatus according to the first embodiment, the supply of the developing agent to the storage device 2 from the bottle 1 can be stopped by a shutter 1*b* as shown in FIG. 3. The shutter 1*b* may be set in an opened condition when fitted, or the shutter 1*b* may be electrically opened/closed by a solenoid or the like.

In addition, in the first embodiment, the excessive supply of the developing agent from the bottle 1 to the storage device 2 is prevented by providing a developing-agent detecting means 7*a* composed a piezoelectric sensor or the like on the storage device 2.

That is, when the developing agent in the storage device 2 is reduced in quantity, the output of the developing-agent detecting means 7*a* is changed, and the conveying means 4 in the bottle 1 is driven based on the output of the developing-agent detecting means 7*a*. Then, the developing agent is discharged from the discharge port in the bottle 1, and the conveying means 4 is stopped when the output of the developing-agent detecting means 7*a* is again changed by the increase in quantity of the developing agent in the storage device 2, so as to keep the quantity of the developing agent in the storage device 2 to be constant. In addition, the image forming action is prohibited by making a judgment that no developing agent is present by a developing-agent detecting means 7*b* composed of a piezoelectric sensor provided also on the storage device 2.

Further, in the first embodiment, the developing agent in the storage device 2 can be uniformly distributed in the longitudinal direction immediately after the developing agent is replenished, by setting the fitting position of the developing-agent detecting means 7*a* and 7*b* on an end part opposite to a receiving opening side where the developing agent is conveyed from the bottle 1 on the side surface in the storage device 2. In addition, when the developing agent is reduced in quantity, the reduction can be notified to a user in an early stage.

Then, the leveling means 5 arranged in the storage device 2 is described. As illustrated in FIG. 3, the developing agent conveyed from the connection part 1*a* is conveyed toward the end part in the longitudinal direction, and would be heaped at the end part if no action is made. Thus, in the first embodiment, the developing agent at the end part is uniformly distributed over the whole area in the longitudinal direction by operating the leveling means 5.

In the first embodiment, the leveling means 5 in the storage device 2 is provided with an oval leveling means part 50 having a ring-shaped part (hereinafter, referred to as "oval leveling means 50") and a screw-type leveling means part 50*a* (hereinafter, referred to as "screw-type leveling means 50*a*").

Figure 4:
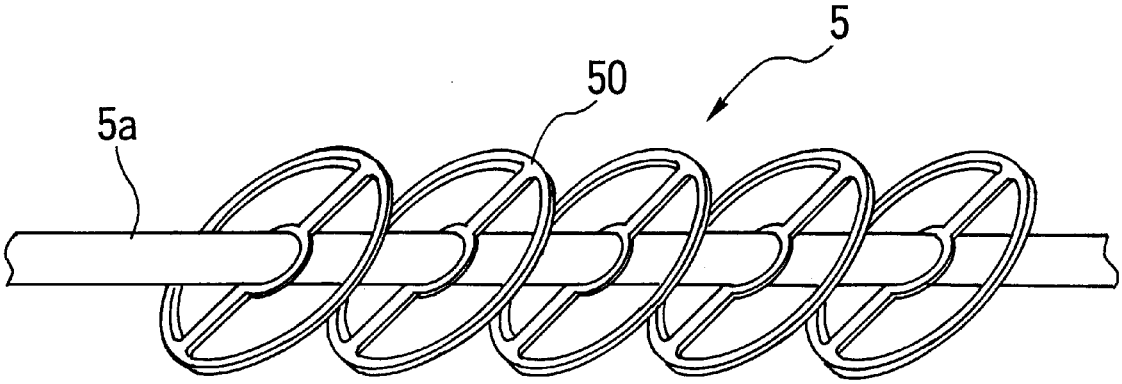
FIG 4 is a schematic view showing a plate member part of a stirring means provided in a developing-agent supply device shown in FIG. 3.

As shown in FIG. 4, the oval leveling means 50 is provided with the ring-shaped part and a part to support the ring-shaped part by a rotary shaft, and is also provided with an opening part between the ring-shaped part and the rotary shaft. Because the ring-shaped part is provided with a plurality of substantially elliptical plates (hereinafter, referred to as "oval plates") on a shaft 5*a* at the angle of inclination with specified intervals, the effect of, rather than conveying the developing agent from one end to the other, expanding the developing agent over the whole area during the rotation, can be demonstrated.

Thus, the image forming apparatus in the first embodiment allows the developing agent in the storage device 2 to be uniformly leveled over the whole area in the longitudinal direction by the oval leveling means 50. Further, the image forming apparatus is excellent in the stirring capacity, and is capable of stirring the developing agent even when the developing agent is solidified.

The screw-type leveling means 50*a* is provided with a screw-type leveling means 51 which is a screw-shaped member with the capacity to convey the toner (developing agent) in the direction A (the direction of the rotary shaft of the leveling means) in FIG. 3, and a screw-type leveling means 52 which is a screw-shaped member with the capacity to convey the toner in the direction opposite to the direction A. The screw-shaped members are provided with an opening part between the rotary shaft and themselves. The screw-type leveling means 50*a* is larger in the developing-agent conveying capacity than the leveling means 50 provided with the ring-shaped part, but smaller in the developing-agent stirring capacity than the leveling means 50 provided with the ring-shaped part.

The screw-type leveling means 50*a* is disposed in the vicinity of the position where the toner is conveyed from the bottle 1 into the storage device 2, i.e., in the vicinity of a toner inlet which is a supply port of the storage device 2.

Figure 5:
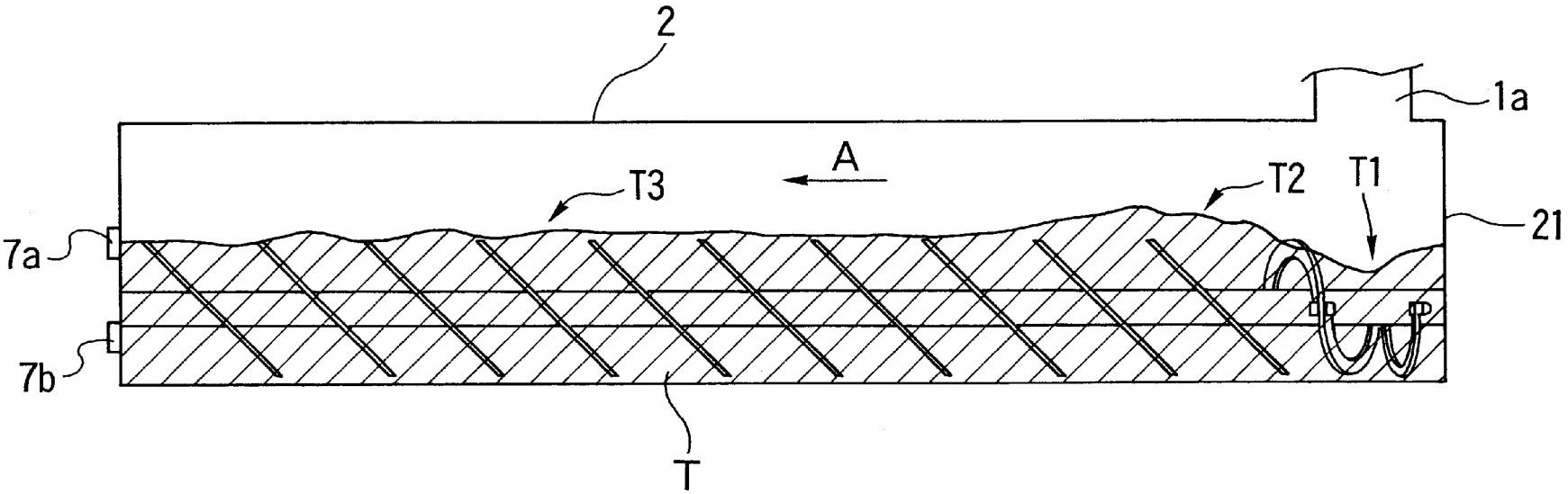
FIG 5 is an explanatory view of the condition of the developing agent in a developing-agent supply part provided in the developing-agent supply device shown in FIG. 3.

The condition T of the toner in the storage device 2 by the action of the leveling means 5 is illustrated in FIG. 5. The toner is of recessed shape at a part T1 in which the toner is conveyed from the bottle 1, and is stored in the storage device 2.

This is because the conveying speed (leveling speed) of the toner in the direction A is higher at the convey-in part T1 of the toner from the bottle 1 than that at other parts.

Further, at a merging part of the screw-type leveling means 51 and the oval leveling means 50, the toner conveying speed (leveling speed) becomes low, so that the toner is inversely heaped in a projecting shape T2.

Still further, when the toner is conveyed in the direction A, the toner is stored in an approximately uniform manner (T3). In this condition, the toner is detected by the toner detecting means 7*a*.

In addition, a screw-type leveling means 52 to convey the toner in the direction toward a side surface 21 is provided in the vicinity of the side surface 21 of the storage device 2 in the direction opposite to the direction A. The screw-type leveling means 52 conveys the toner conveyed from the bottle 1 in the direction opposite to the direction A, but no toner overflows onto the side surface 21 because the toner conveying capacity of the screw-type leveling means 52 is smaller than that of the screw-type leveling means 51.

Figure 7A:
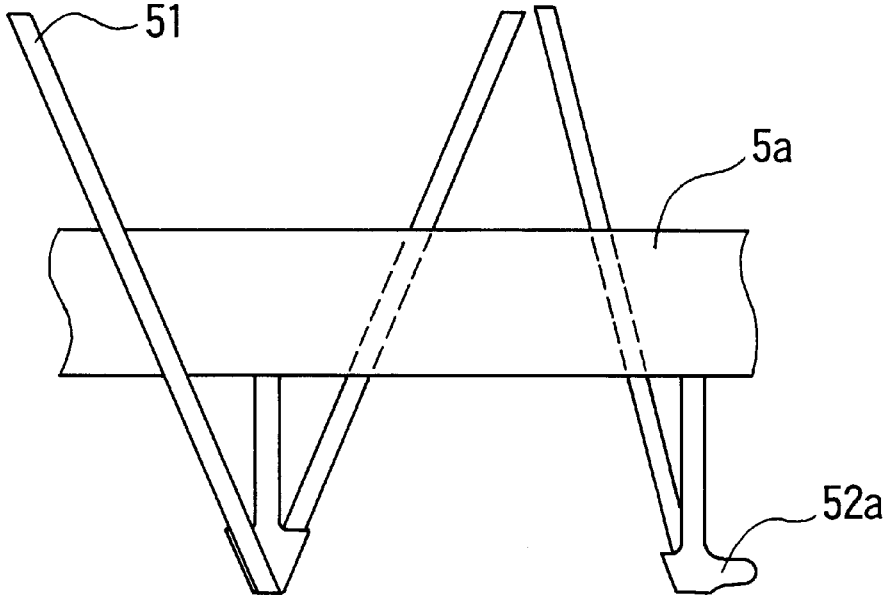
FIGS. 7A and 7B are schematic views showing a screw-shaped member pa t of the stirring means provided in the developing-agent supply device shown in FIG. 3.
Figure 7B:
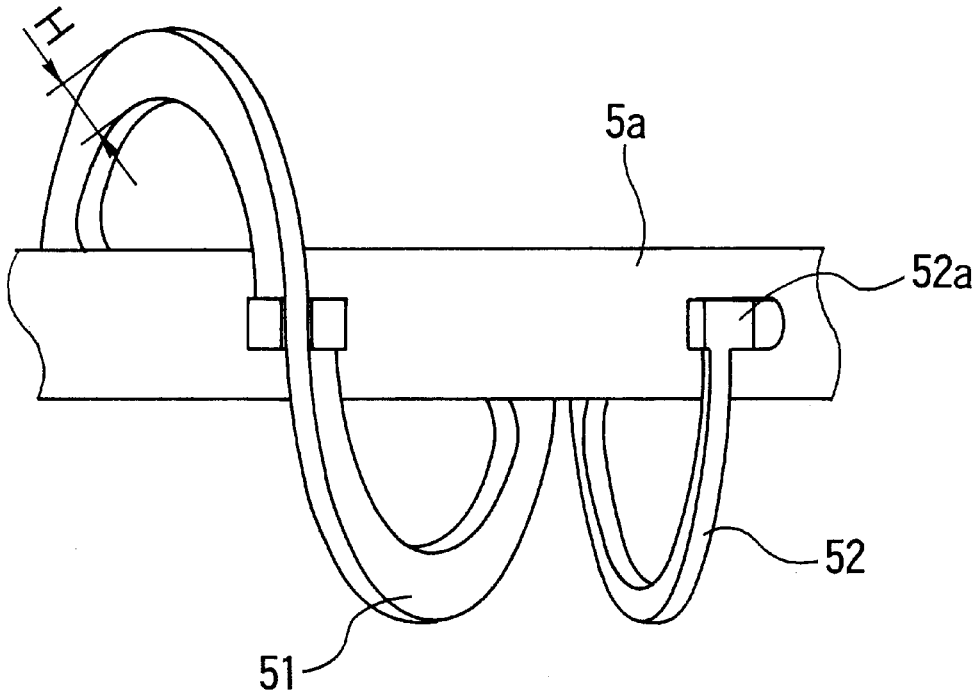

As shown in FIGS. 7A and 7B, a projecting part 52*a* is formed from the screw-type leveling means 52 between the screw-type leveling means 52 and the side surface 21, so that no dead space where the toner is not conveyed is formed in the vicinity of the side surface 21 of the storage device 2 by the screw-type leveling means 52. FIGS. 7A and 7B are two views of a screw part. What is individually worried is whether or not the toner is conveyed to the developer container 102*a* uniformly in the longitudinal direction because recessed parts and projecting parts are provided in the toner storage part.

Figure 6:
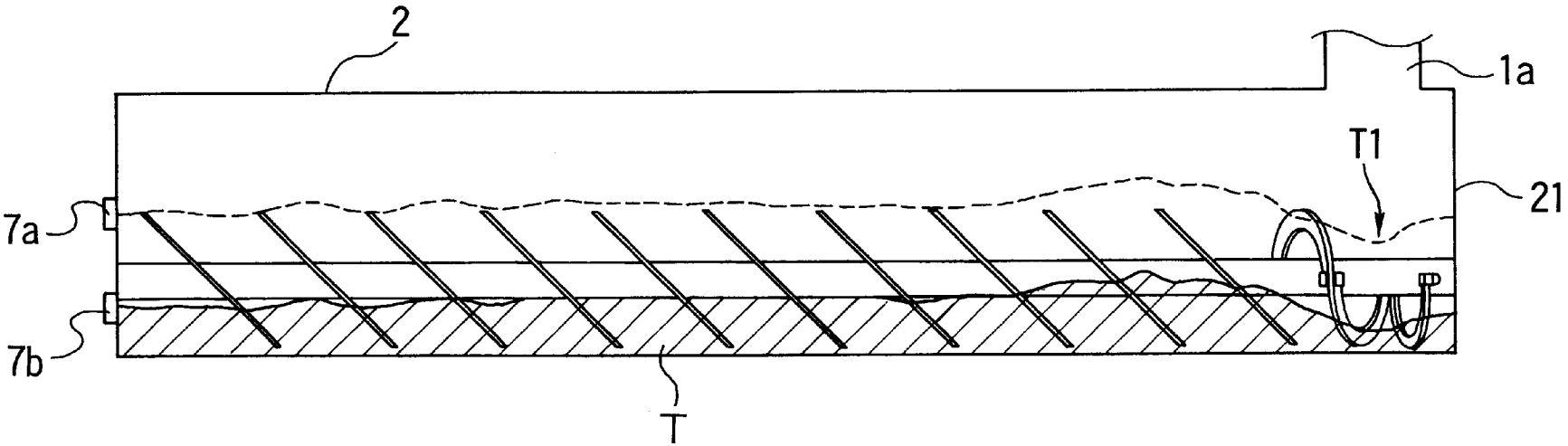
FIG. 6 is an explanatory view of the condition of the developing agent in the developing-agent supply part provided in the developing-agent supply device shown in FIG. 3.

As shown in FIG. 6, the quantity of the toner in the toner storage recessed part T1 is regulated so that the toner is uniformly replenished to the developer container 102*a* in the longitudinal direction between the detecting means 7*a* and the detecting means 7*a* until the toner detecting means 7*a* (lower one) in the storage device 2 detects that no toner is present.

To achieve this, the toner conveying capacity of the screw-type leveling means 51 is regulated. The regulation is achieved by changing the width H or the like of an outer rib in addition to the pitch and the number of revolution of the screw. The conveying quantity is reduced if the width of the outer rib is reduced, vice versa, as shown in FIGS. 7A and 7B. (This is also true for the screw-type leveling means 52.)

The screw-type leveling means 51 and 52 are of void shape inside the contour of the screw, and is, therefore, excellent in the toner stirring capacity.

In addition, the quantity of the toner in the toner storage recessed part can also be regulated by bringing the oval leveling means 50 close to or away from the screw-type leveling means 51. The quantity of the toner in the recessed part is decreased when these means are brought close to each other, and increased when these means are brought away from each other.

Because the storage device 2 conveys the toner uniformly to the developer container 102*a* in the longitudinal direction between the toner detecting means 7*a* and the toner detecting means 7*b*, even when a screw-type leveling means is provided on a part thereof as illustrated in the first embodiment, the rotation of the screw-type leveling means need not be reversed.

As described above, the toner can be conveyed to the developer container uniformly in the longitudinal direction by regulating the quantity of the toner in the toner storage recessed part. In addition, the toner conveying property in the longitudinal direction at a shutter roller 8 to convey the toner from the storage device 2 to the developer container 102*a* can be regulated so that more toner can be conveyed to only a part (in the vicinity of the recessed part).

Figure 8:
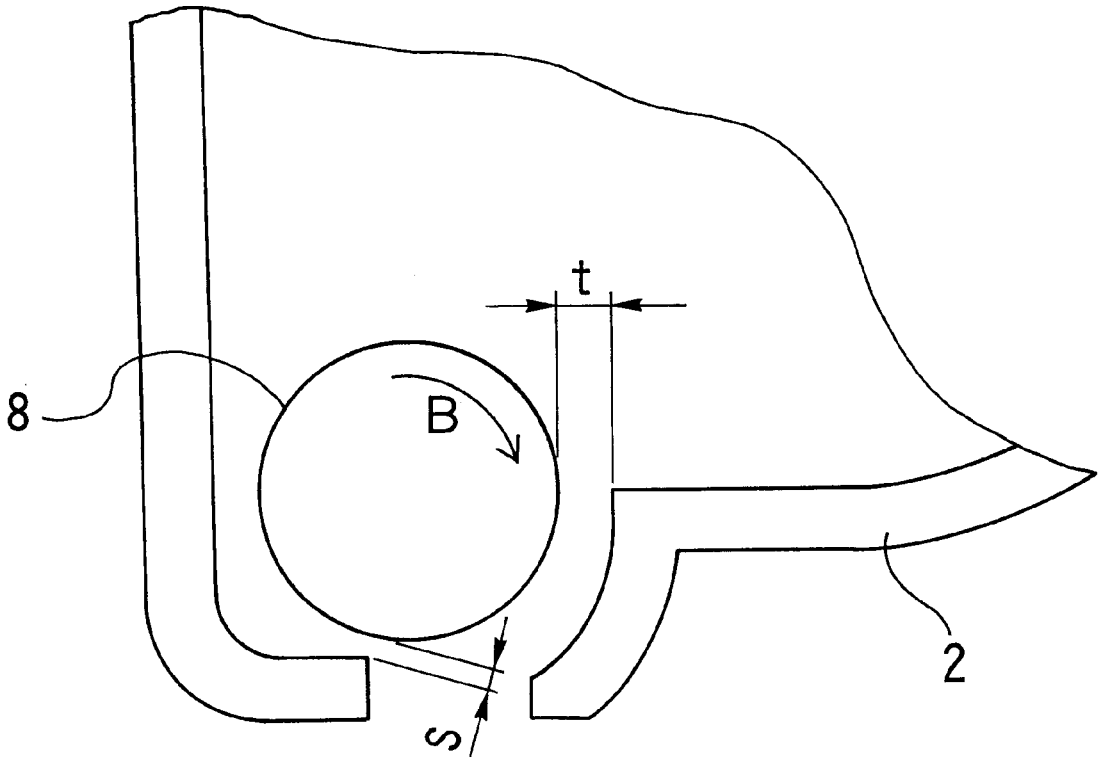
FIG. 8 is an explanatory view of the constitution of a discharge port provided in the developing-agent supply part in the first embodiment of the present invention.

The shutter roller 8 is arranged as shown in FIG. 8. When the shutter roller 8 is rotated in the direction of the arrow B, the toner in a clearance "t" between the container of the storage device 2 and the roller 8 is moved as the shutter roller 8 is rotated. In addition, when the toner is moved, the toner is conveyed to the developer container 102*a* by the quantity corresponding to the difference between "t" and "s" (t>s) by the clearance "s" between the container of the storage device 2 and the roller 8.

Although, in the conventional developing device, the above-described difference is uniform in the longitudinal direction, the clearance "t" (or "s") at a part in the longitudinal direction, in the first embodiment, is varied as measures for unifying the quantity of the toner in the longitudinal direction, so that the quantity of supply of the toner to the developer container is made more uniform in the longitudinal direction as a result. For example, in the case of a clearance where the above-described difference (t−s) is longitudinally uniform in the vicinity of the toner storage recessed part, as in the conventional developing device, the quantity of the toner to the developer container is slightly reduced only in the vicinity of the recessed part. On the other hand, in the first embodiment, the above-described difference (t−s) is increased only in the vicinity of the recessed part (the opening part 1*a*) of the toner in the storage device 2, so that the toner conveyance to the developer container 102*a* is regulated to be uniform in the longitudinal direction.

The developing agent which is uniformly leveled in the longitudinal direction in the storage device 2 is thus uniformly supplied approximately over the whole area in the longitudinal direction of the developer container 102*a* through the connection port 2*a* forming the discharge port as the communication port provided approximately over the whole area in the longitudinal direction of the developer container 102*a*, so that the occurrence of defective images can be prevented.

The developing agent in the storage device 2 is replenished to the developer container 102*a* through the connection port 2*a* by the action of the shutter roller 8, as illustrated in FIG. 8. The shutter roller 8 is operated by the electric signal from a developing-agent detecting means (not shown) in the developer container 102*a*, and is controlled so that the quantity of the developing agent in the developer container 102*a* is made constant. Incidentally, the constitution of the shutter roller 8 is not limited to a roller.

As described above, in the first embodiment, the toner is conveyed from the bottle to the storage device at the end part of the storage device. However, the present invention is not necessarily limited thereto, and the capacity of leveling the toner from the bottle in the longitudinal direction can be regulated by combining the oval type with the screw type as the leveling means.

Thus, in the first embodiment, the screw-type leveling means 51 and the screw-type leveling means 52 level the developing agent in the vicinity of the supply port in the storage device 2 while conveying the developing agent opposite to each other in the axial direction of the leveling means 5 by the rotation of the shaft 5*a* of the leveling means 5, and the oval-type leveling means 50 levels the developing agent. Accordingly, the developing agent to be supplied from the bottle 1 into the storage device 2 can be conveyed and leveled in the axial direction of the leveling means 5 without storing the developing agent in the vicinity of the supply port, and the developing agent is supplied uniformly in the axial direction from the storage device 2 to the developer container 102*a*.

Second Embodiment

Next, a second embodiment of the present invention is described. The same reference numerals are given to the components similar to those of the first embodiment, and the description of those components is omitted.

In the second embodiment, the constitution of the toner conveyance to the vicinity of the central portion of the storage device is described.

Figure 9:
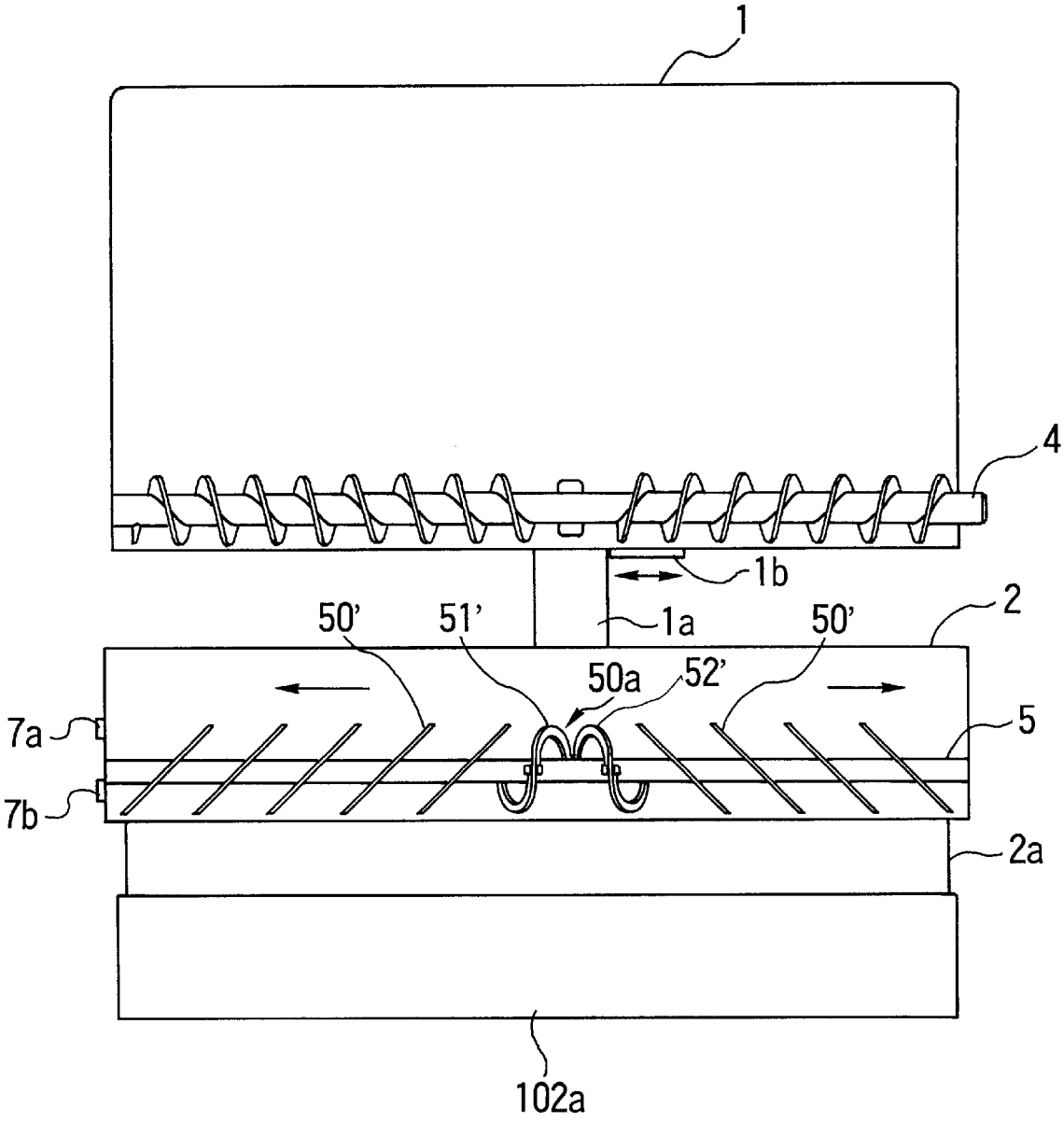
FIG. 9 is a schematic sectional view showing the outline constitution of the developing device according to a second embodiment of the present invention.
Figure 10:
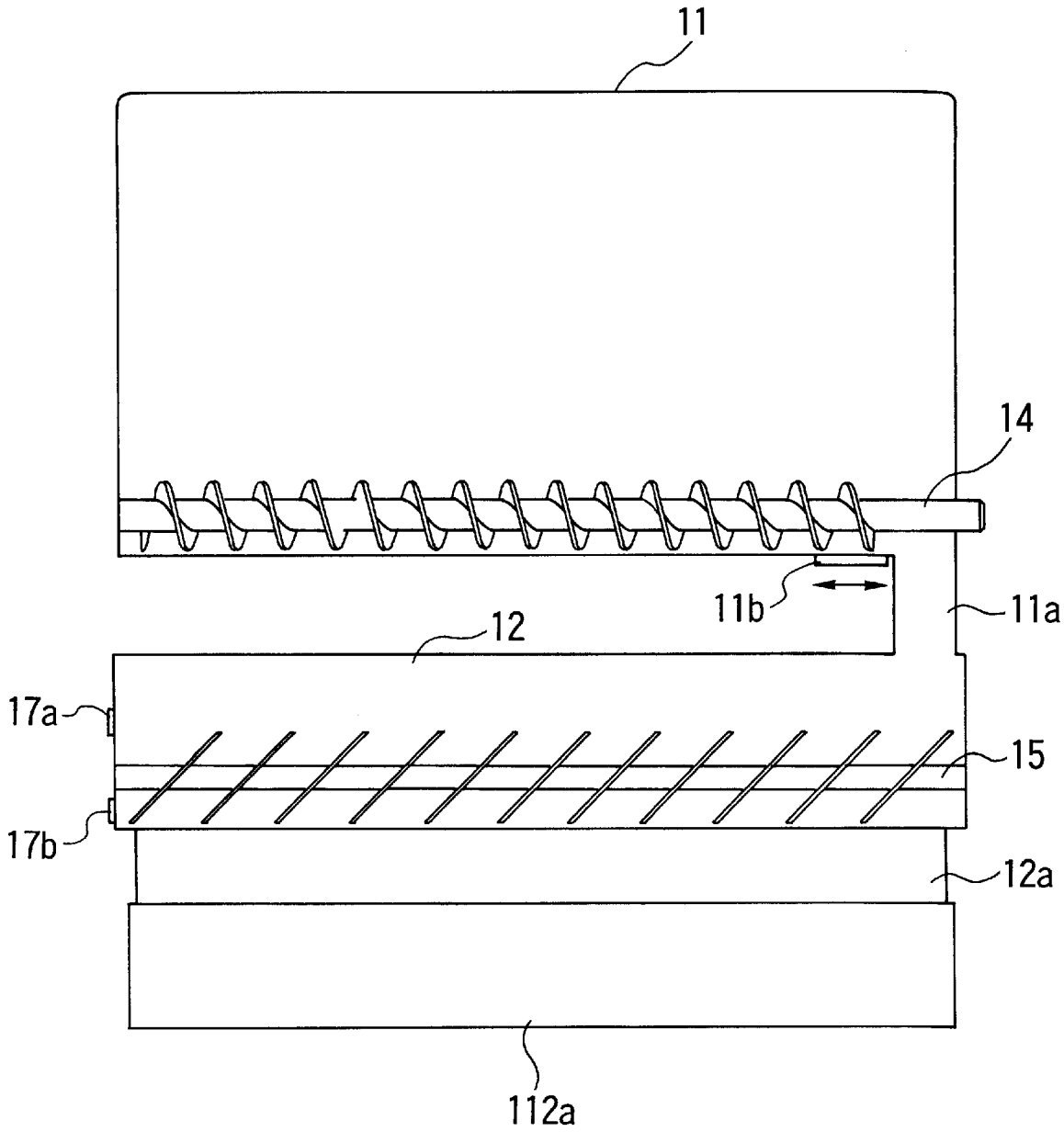
FIG. 10 is a schematic sectional view showing the outline constitution of a conventional developing device.

FIG. 9 shows an outline constitution of a developing-agent replenishment container and a developing-agent storage device in the second embodiment.

In the second embodiment, a screw-type leveling means 51', which is a screw-shaped member, and a screw-type leveling means 52', which is a screw-shaped member having the conveying capacity of conveying the toner in the direction opposite to the conveying direction of the screw-type leveling means 51', are provided on a drop part for the toner from the bottle 1. Further, in the second embodiment, in oval-type leveling means 50' having ring-shaped parts provided on both side of the drop part, the directions of inclination of the oval type on both sides are opposite to each other, as shown in FIG. 9, but because the leveling capacity of the oval-type leveling means is little different with the rotational direction, the present invention is not limited to such an arrangement.

In the second embodiment, regulation is achieved so that a recessed part is formed in a toner storage part at the drop part for the toner from the bottle 1, and the toner is uniformly replenished to the developer container 102*a*, similarly to the first embodiment.

Further, in both the first embodiment and the second embodiment, the leveling means 5 in which screws different in the toner conveying direction are combined with each other is provided. However, the present invention further includes the constitution that the oval-type leveling means is arranged between the screw-type leveling means, or the screw-type leveling means and the oval-type leveling means are alternately arranged according to the size, shape or the like of the storage device.

What is claimed is:

1. A developing-agent receiving device, which discharges a developing-agent received from a developing-agent replenishment container to a developing device, said developing-agent receiving device comprising:

a developing-agent storage portion for receiving the developing agent;

a receiving opening for receiving the developing agent from said developing-agent replenishment container, said receiving opening being provided at said developing-agent storage portion;

conveying means for conveying the developing agent within said developing-agent storage portion; and a discharging opening for discharging the developing agent conveyed by said conveying means to said developing device, said discharging opening being provided along a longitudinal direction of said developing-agent storage portion, wherein a developing-agent conveying ability of said conveying means from said receiving opening toward one end portion in the longitudinal direction of said developing-agent storage portion in a first conveying portion away from said receiving opening toward said one end portion side is smaller than a conveying ability in a second conveying portion near said receiving opening, and further a width of said discharging opening in said first conveying portion is greater than a width of said discharging opening in said second conveying portion.

2. A developing-agent receiving device according to claim 1, wherein said conveying means conveys the developing agent from said receiving opening toward an opposite end portion from said one end portion in a longitudinal direction of said developing-agent storage portion, and is provided with at third conveying portion in which the developing-agent conveying ability is smaller than the conveying ability in said second conveying portion.

3. A developing-agent receiving device according to claim 2, wherein said receiving opening is located near said opposite end portion in the longitudinal direction of said developing-agent storage portion.

4. A developing-agent receiving device according to any one of claims 1 to 3, wherein said second conveying portion is provided with a screw portion.

5. A developing-agent receiving device according to clam 4, wherein said first conveying portion is provided with a plurality of ring portions, each of said plurality of ring portions having a surface inclined with respect to the developing-agent conveying direction.

6. A developing-agent receiving device, which receives a developing agent from a developing-agent replenishment container, said developing-agent receiving device comprising:

a developing-agent storage portion for storing the developing agent;

a receiving opening for receiving the developing agent from said developing-agent replenishment container, said receiving opening being provided at one end portion of a longitudinal direction of said developing-agent storage portion; and conveying means for conveying the developing agent within said developing-agent storage portion, said conveying means being provided with a first conveying portion for conveying the developing agent near said receiving opening toward said one end portion and a second conveying portion for conveying the developing agent near said receiving opening toward an opposite end portion from said one end portion in the longitudinal direction of said developing-agent storage portion, wherein developing-agent conveying ability in said first conveying portion is smaller than a conveying ability in said second conveying portion.

7. A developing-agent receiving device according to claim 6, wherein said first conveying portion and second conveying portion are each provided with a screw portion.

* * * * *

UNITED STATES PATENT AND TRADEMARK OFFICE

CERTIFICATE OF CORRECTION

PATENT NO. : 6,456,809 B1
DATED : September 24, 2002
INVENTOR(S) : Hajime Sekiguchi It is certified that error appears in the above-identified patent and that said Letters Patent is hereby corrected as shown below:

Column 2,
Line 1, “take” should read -- take a --;
Line 12, “to as” should read -- to as a --;
Line 60, “he” should read -- the --; and
Line 62, “SEVERHL.” should read -- SEVERAL. --.

Column 3,
Line 17, “pa t” should read -- part --.

Column 4,
Line 1, “as” should read -- as a --;
Line 44, “non-uniform.” should read -- nonuniform. --; and
Line 63, “a” should read -- of a --.

Column 5,
Line 34, “as” should read -- as an --.

Column 6,
Line 49, “7a” (both occurrences) should read -- 7b --.

Column 8,
Line 38, “side” should read -- sides --; and
Line 58, insert the following paragraph,
-- Thus, in the first embodiment, the leveling means 5 in the storage device 2 is composed of a combination of the oval-type leveling means 50 and the screw-type leveling means 51 and 52, so that the developing device can be prevented from being stuffed with the toner due to the increase in the discharge quantity of the toner from the bottle 1, and at the same time, the overflow of the toner caused by such toner stuffing can be prevented. Accordingly, the fluctuation in the toner discharge from the bottle 1 can be coped with by the constitution of the leveling means 5 in the storage device 2.

Further, in the second embodiment, the screw-type leveling means 51’ and the screw-type leveling means 52’ level the developing agent in the vicinity of the supply port in the storage device 2 while conveying the developing agent from the supply port in the opposite directions along the axial direction of the leveling means 5 by the rotation of the shaft 5a of the leveling means 5, and, at the same time, the oval-type leveling means 50 levels the developing agent. Accordingly, the developing agent supplied from the bottle 1 into the storage device 2 can be conveyed and leveled in the axial direction of the leveling means 5 without storing the developing agent in the vicinity of the supply port, and the developing agent can be supplied from the storage device 2 to the developer container 102a uniformly in the above-described axial direction. --

UNITED STATES PATENT AND TRADEMARK OFFICE

CERTIFICATE OF CORRECTION

PATENT NO. : 6,456,809 B1
DATED : September 24, 2002
INVENTOR(S) : Hajime Sekiguchi It is certified that error appears in the above-identified patent and that said Letters Patent is hereby corrected as shown below:

Column 9,
Line 26, "at" should read -- a --.

Column 10,
Line 1, "clam" should read -- claim --.

Signed and Sealed this

First Day of April, 2003

JAMES E. ROGAN
*Director of the United States Patent and Trademark Office*